US007427424B2

(12) United States Patent
Hill

(10) Patent No.: US 7,427,424 B2
(45) Date of Patent: Sep. 23, 2008

(54) SYSTEMS AND METHODS OF BONDING MATERIALS

(76) Inventor: David A. Hill, 2868 NW. Polarstar, Bend, OR (US) 97701

( * ) Notice: Subject to any disclaimer, the term of this patent is extended or adjusted under 35 U.S.C. 154(b) by 264 days.

(21) Appl. No.: 10/638,104

(22) Filed: Aug. 7, 2003

(65) Prior Publication Data

US 2005/0028938 A1 Feb. 10, 2005

(51) Int. Cl.
*B05D 5/10* (2006.01)
*B05D 7/00* (2006.01)

(52) U.S. Cl. ..... 427/207.1; 118/632; 118/315

(58) Field of Classification Search ..... 427/421.1, 427/207.1; 156/331.4; 118/300, 632, 315
See application file for complete search history.

(56) References Cited

U.S. PATENT DOCUMENTS 3,324,844 A 6/1967 Gruber
3,374,987 A 3/1968 Joyce et al.
3,831,342 A * 8/1974 Rejsa ..... 53/491
3,896,081 A * 7/1975 Baxter et al. ..... 525/509
3,947,425 A 3/1976 Freeman et al.
3,963,546 A 6/1976 Roberti
4,028,310 A 6/1977 Schafer et al.
4,366,918 A 1/1983 Naka
4,493,286 A 1/1985 Carson
4,595,445 A 6/1986 Hombach et al.
4,663,201 A 5/1987 House et al.
4,764,242 A * 8/1988 Gressick et al. ..... 156/494
4,798,862 A 1/1989 Gillis, Jr.
4,893,643 A 1/1991 Gifford et al.
5,013,813 A 5/1991 Zimmerman et al.
5,104,930 A 4/1992 Rinde et al.
5,124,426 A 6/1992 Primeaux, II et al.
5,126,173 A 6/1992 Machenaud
5,218,005 A 6/1993 Zimmerman et al.
5,225,118 A 7/1993 Juang et al.
5,317,076 A 5/1994 Primeaux, II
5,384,385 A 1/1995 Trinks et al.
5,388,761 A 2/1995 Langeman
5,442,034 A 8/1995 Primeaux, II
5,496,911 A 3/1996 Smith
5,504,181 A 4/1996 Primeaux, II
5,580,945 A 12/1996 Wade et al.
5,626,705 A 5/1997 Winterowd et al.
5,683,752 A * 11/1997 Popp et al. ..... 427/8
5,731,397 A 3/1998 Primeaux, II et al.
5,759,695 A 6/1998 Primeaux, II
5,810,254 A 9/1998 Kropfield
5,944,938 A 8/1999 Winterowd et al.
6,176,961 B1 1/2001 Mossbeck et al.
6,630,028 B2 * 10/2003 Briese et al. ..... 118/683
2002/0177376 A1 * 11/2002 Welch et al. ..... 442/50
2003/0024640 A1 * 2/2003 Hill ..... 156/331.4
2004/0170856 A1 * 9/2004 Arndell et al. ..... 428/535

OTHER PUBLICATIONS

U.S. Appl. No. 60/430,913, filed Dec. 4, 2002, Arndell et al., Specification pp. 6-10.*
"Chemical Resistance Testing for Polyurea Spray Elastomers," *Huntsman Industry Article*, Date Unknown (3 pgs. total).

(Continued)

*Primary Examiner*—William P. Fletcher, III
*Assistant Examiner*—Cachet I Sellman
(74) *Attorney, Agent, or Firm*—Kolisch Hartwell, P.C.

(57) ABSTRACT

Systems and methods for depositing glue on workpieces transported on a conveyor utilizing apparatus for mixing rapid gelling glue components and depositing glue mixtures in defined patterns.

10 Claims, 7 Drawing Sheets

OTHER PUBLICATIONS

Permax Roofing & Insulation Systems brochure, Resin Technology Co., Date Unknown (4 pgs. total).
Permax 700 HP, RTC Elastomeric Coating and Polyurea Coatings, Technical Information, Date Unknown, (3 pgs. total).
Material Safety Data Sheet, Resin Technology Company, May 13, 1993.
"A Study of Polyurea Spray Elastomer Systems," *Huntsman Industry Article*, Reprint, *High Solids Coatings*, vol. 15, 1994, pp. 1-8.

* cited by examiner

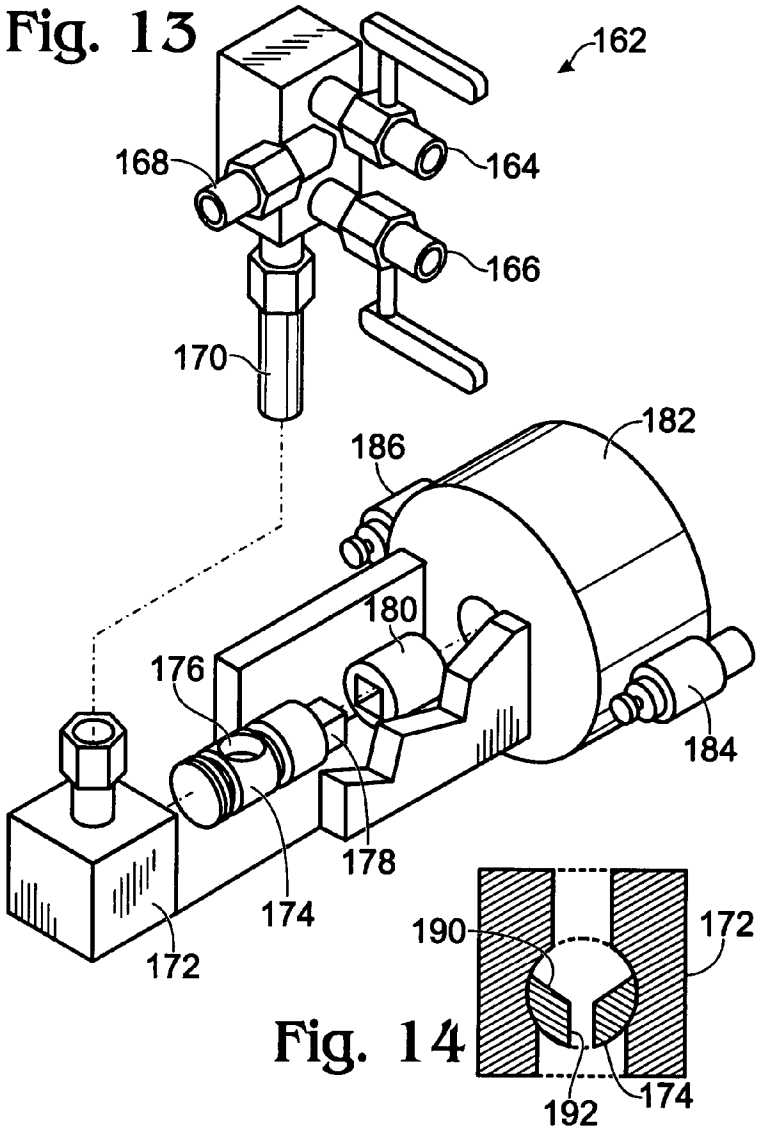
Fig. 13
Fig. 14
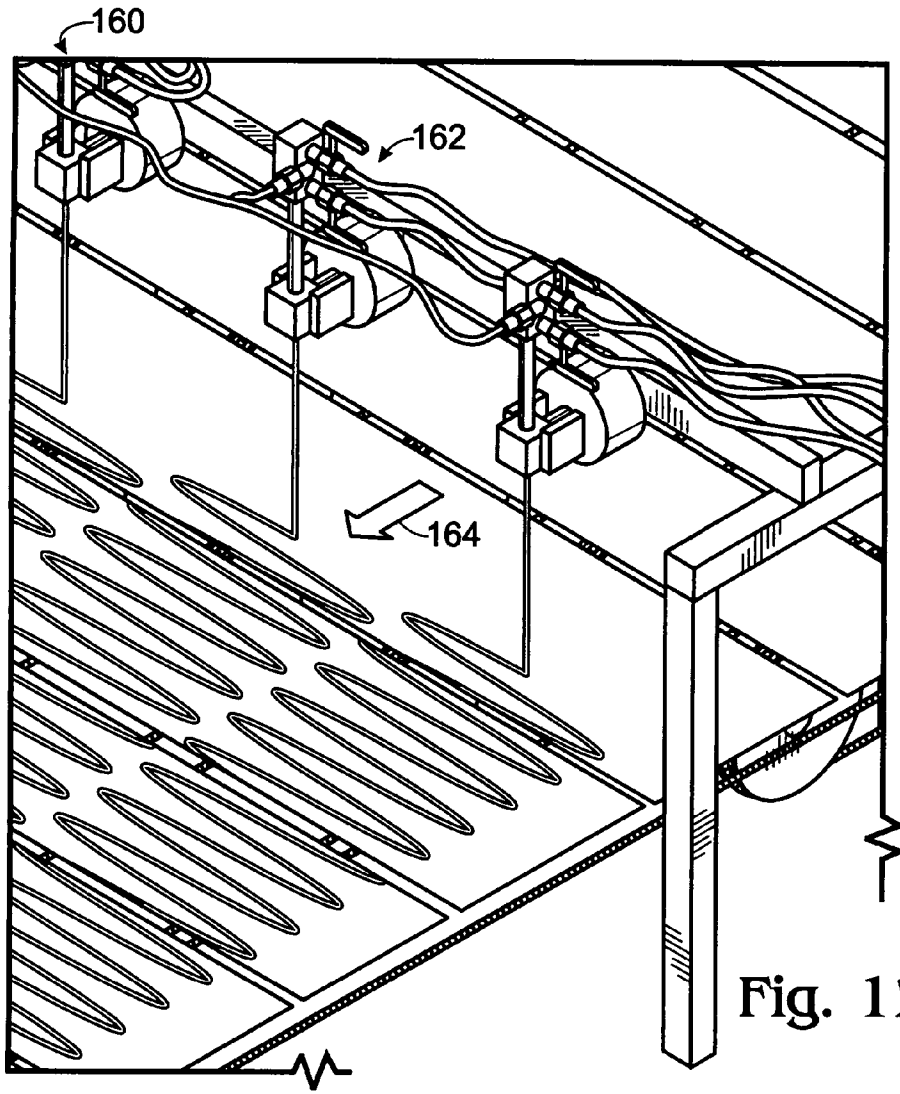
Fig. 12

SYSTEMS AND METHODS OF BONDING MATERIALS

FIELD OF THE INVENTION

The invention relates to bonding of materials. In particular, an example of the invention involves application of rapid curing adhesive to bond wood components together.

BACKGROUND AND SUMMARY OF THE INVENTION

In woodworking applications, it is often necessary to bond wood pieces together to produce a wood product. For example, recent environmental regulations and depletion of old-growth timber supplies have made it increasingly difficult and expensive for manufacturers to obtain high-grade lumber to use in wood products, for example including furniture, cabinets and millwork. One way of addressing the shortage and high cost of high quality lumber is the use of veneered stock. Typically, veneered wood products are created by laminating high quality veneer over a lower grade core material, such as medium density fiberboard (MDF), particle board, plywood or finger-jointed stock. Use of veneered wood members results in a substantially more efficient utilization of high quality wood, and therefore reduces raw material costs. Other examples of wood products produced by joining wood members together include door and window jambs, plywood, laminated veneer lumber, and other laminated wood products.

For most woodworking applications, a wood bond must be strong in order to provide structural strength and stability. For example, it is often desirable to form a "high-strength wood bond" that has a shear-strength exceeding the shear-strength of the wood itself. Generally, high strength wood bonding procedures require application of an adhesive to a wood surface, and subsequent pressing of the wood surface against another wood surface or against a polymeric material such as PVC, polyethylene, polystyrene, polypropylene, phenolic paper and wood fiber composites with any one of the above-listed polymers.

One significant limitation with prior wood bonding techniques is that the procedure required to produce a high-strength wood bond may take a long time, for example, several hours, to produce a cured product.

Other procedures can be performed more rapidly by using an adhesive that is activated to some extent during the pressing process. For example, adhesives may be activated by applying heat. These adhesives are referred to as "thermoset adhesives." Presses may use heating platens or radio frequency mechanisms to activate and speed up significantly the cure time of a thermoset adhesive. Presses with heat activation mechanisms are generally complex, and expensive. These presses may also be limited in their ability to achieve uniform curing in some composite configurations.

Another way of activating an adhesive during pressing is to use a two-part adhesive system in which the two parts are substantially separate and unmixed until the pressing step, sometimes referred to as a "honeymooning" process. For example, see U.S. Pat. Nos. 5,944,938 and 5,626,705. However, a problem with this approach is that the pressing step may not adequately or reproducibly mix the two adhesive parts, thereby creating an inferior or inconsistent bond, or causing delays in the curing process. Another problem with a honeymooning process is that it is difficult to control the actual ratio of mixed adhesive components due to variable penetration or dilution of the components into the wood prior to mixing, particularly where the moisture content of the wood is variable.

There is a need for simplified wood bonding systems and procedures that can produce a rapidly-curing, high-strength wood bond between different types of wood pieces having a wide range of possible moisture contents, and between wood and polymeric materials such as vinyl, without requiring complicated adhesive activation steps while the wood pieces are being pressed.

The current inventor previously filed U.S. patent application Ser. No. 10/007,624 which discloses uses of rapid gelling two-part adhesive systems to quickly form high strength bonds between materials. This application is hereby incorporated by reference in it entirety, and is not in any way admitted to be prior art relative to the current invention.

One of the challenges with using rapid curing adhesives is that the fluid adhesive must be channeled, accurately metered, and uniformally dispensed over a short time window during which the fluidic properties of the adhesive change significantly as polymeric bonds are formed and the curing process moves rapidly toward completion. Various applicating systems are disclosed in the '624 application. Some of the previously disclosed systems involve spray techniques. However, some desirable adhesive formulations may not be conducive to spraying application.

Accordingly, an example of the invention involves use of a dispensing tube suspended across a material conveyor. The tube has a plurality of apertures for dispensing adhesive. Rapid gelling adhesive components are mixed and injected into both ends of the tube, and subsequently dispensed through the apertures onto material such as wood veneer being conveyed below the tube. The tube oscillates in a direction non-parallel to the direction of material travel so that the adhesive is deposited in a nonlinear pattern configured to result optimally in a uniform film of desired thickness when the adhesive is sandwiched and pressed between material components.

In another example of the invention multiple dispenser heads are arranged across a conveyor path. Each conveyor head has a conduit defining a stream path for directing glue fluid toward a work piece being transported along the conveyor path, and a drive mechanism for causing the stream path to oscillate resulting in a repeating pattern of glue on the work piece.

In another example of the invention, a plurality of glue mixing and applicating mechanisms are suspended across a conveyor. Each applicating mechanism is equipped with a drive mechanism configured to reciprocate a dispenser so that glue is deposited in a repeating zigzag pattern on materials being conveyed along a processing path.

BRIEF DESCRIPTION OF THE DRAWINGS

FIG. 12 is another partial perspective view of another example of the invention in which applicators are individually driven to produce adjacent zigzag patterns of glue.

FIG. 13 shows a partially exploded isometric view of an applicator used in the example shown in FIG. 12.

FIG. 14 is a schematic sectional view through the device shown in FIG. 13.

DESCRIPTION OF EXAMPLES OF THE INVENTION

The invention includes numerous systems, devices, and methods for depositing glue on material. One aspect of the invention involves a method of mixing rapidly gelling glue systems and depositing the glue uniformly on a moving work piece. For example, the glue may be deposited in a pattern including multiple side-by-side zigzag lines.

Another aspect of the invention utilizes equipment including a tube suspended over a conveyor path. The tube has apertures for dispensing glue which flows into the tube from opposite ends. A drive mechanism causes the tube to oscillate back and forth along a direction non-parallel to the conveyor path, thereby producing multiple repeating adjacent zigzag patterns of glue on the work piece. The glue patterns may be completely separate or may overlap.

Still another aspect of the invention utilizes multiple dispenser heads, each having its own glue injector, mixing chamber, and drive mechanism for repeatably altering the dispense path of a glue mixture. Numerous variables can be tuned and controlled to achieve an infinite number of different glue application objectives. For example, the invention may be used to permit relatively fast glue flow rates compared to a relatively slow material transport rate which is sometimes necessary with glue systems formulated to gel and cure quickly.

Figure 1:
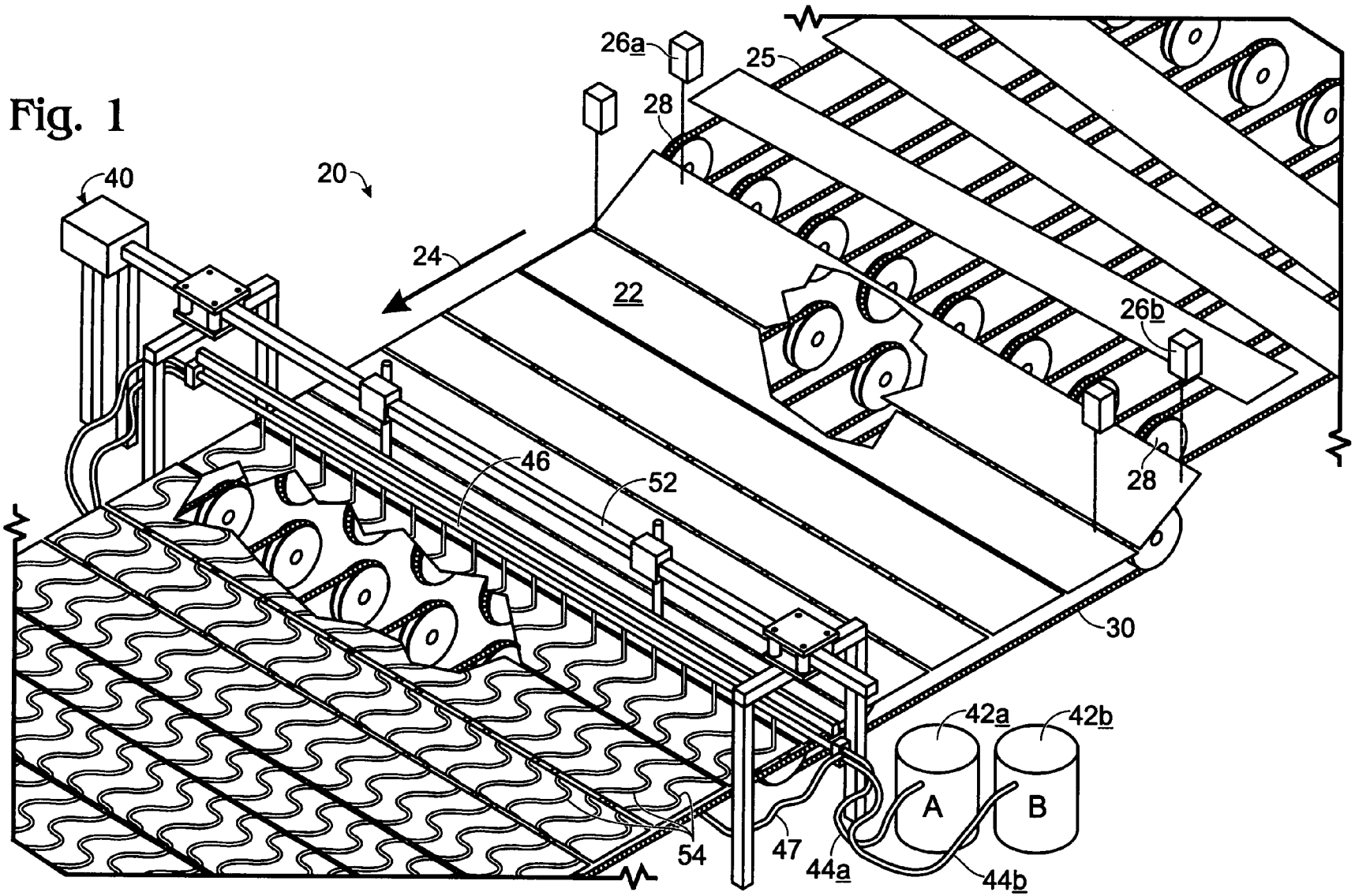
FIG. 1 is a perspective view of a system and apparatus for dispensing glue onto a workpiece.

FIG. 1 shows an example of the invention. Glue or adhesive applicator system 20 is shown conveying work pieces 22 along processing path 24. Individual workpieces 22 are conveyed by infeed 25. Workpieces 22 being conveyed upstream may be spaced apart and skewed. Eyes or sensors 26*a* and 26*b* detect the presence of workpiece ends, causing appropriate independent stopping and/or starting of conveyor belts 28 so that workpiece 22 is oriented perpendicular to processing path 24 prior to being transferred to crowder outfeed 30. Infeed 25 generally runs faster than outfeed 30 so that workpieces are arranged edge-to-edge on crowder outfeed 30. For example, infeed 25 may run at approximately 200-ft-per-minute while outfeed 30 runs at approximately 30- to 60-ft-per-minute.

Crowder outfeed 30 then becomes the conveyor infeed for glue applicator station 40. Workpieces 22 then translate through glue application station 40. Glue applicator station 40 is configured to dispense a mixture of a two-part rapid-curing adhesive system. Component A of the adhesive system is contained in reservoir 42*a*. Component B of the adhesive system is contained in reservoir 42*b*. For example, a glue system may be obtained for this purpose from Bordon. A resin blend of WS 749-002 and WS 749-010 has been used with catalyst number WS 730-139. The gel time for this system is approximately 5 minutes. Hoses 44*a* and 44*b* carry the adhesive components through pumps and temperature control equipment before entering a mixing chamber, and flowing through dispense tube 46. Purge hose 47 is provided to clean out and purge tube 46 when it is not being used to dispense glue. Water, air, or other appropriate fluids may be used for purging.

Tube 46 has multiple holes for dispensing glue onto workpieces 22. Tube 46 may, for example, have an outer diameter of 5/16-inch. The tube may be suspended by about three- to five-inches, or up to 20-inches or more for other applications. Both sides of tube 46 are equipped with an adhesive mixing and pumping system, as previously described, so that a gelling adhesive mixture is injected into the tube from both ends toward the center of tube 46. The holes or apertures in tube 46 may have uniform or varying diameters that increase somewhat towards the center of tube 46 to compensate for a drop in pressure as the glue flows through tube 46. For example, the diameters of the holes are in the approximate range of 30-40 thousandths-of-an-inch.

Tube 46 is connected to rail 52. A mechanism is provided to oscillate or reciprocate rail 52 and tube 46 resulting in deposition of zigzagging glue pattern 54. Any mechanism for oscillating tube 46 may be used. For example, a rotary reciprocator may be used. Alternatively, a hydraulic cylinder, pneumatic cylinder, hydraulic rotary actuator, or pneumatic rotary actuator may be used.

Figure 2:
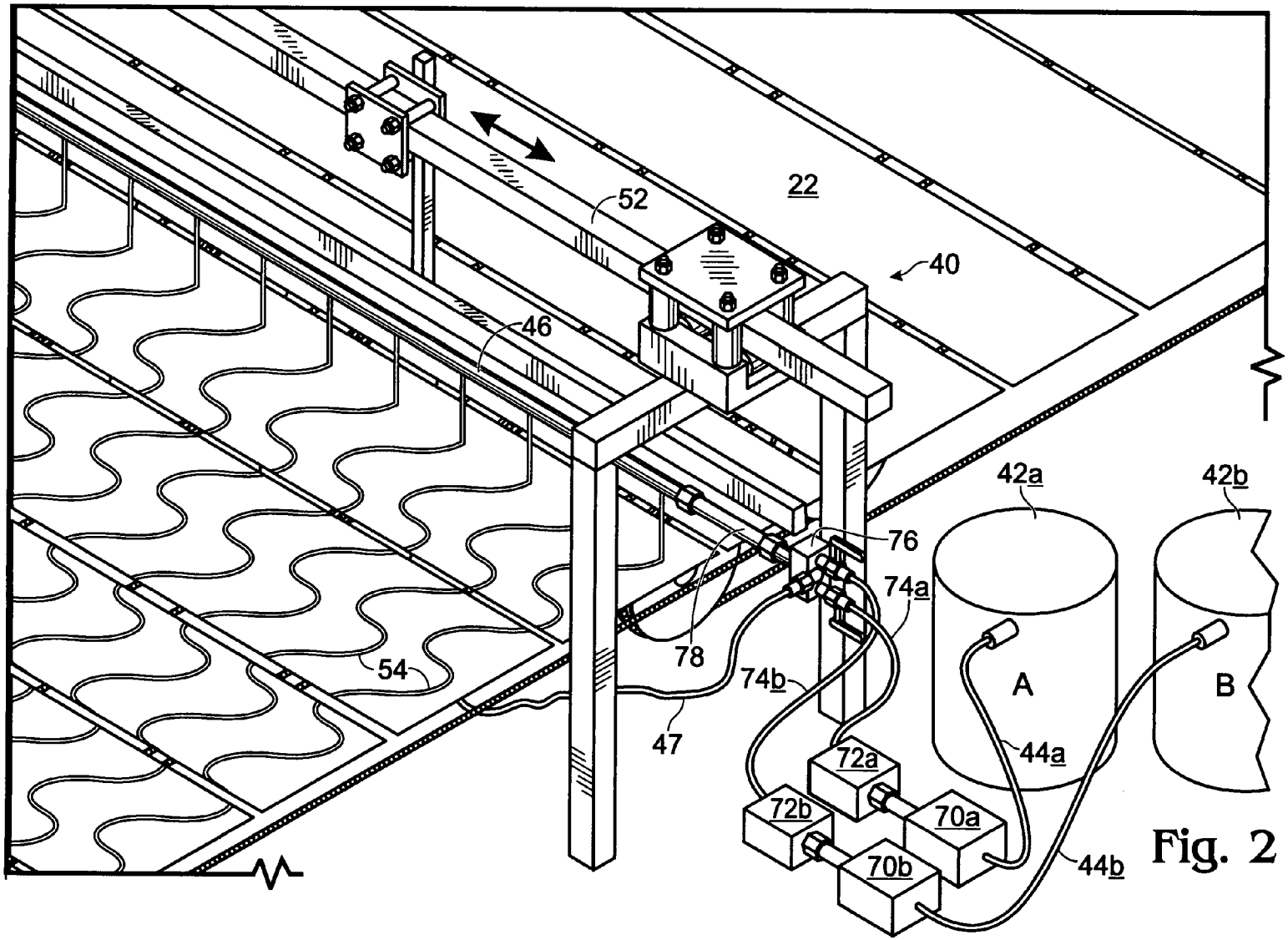
FIG. 2 is a partial perspective view of the system and apparatus shown in FIG. 1, focusing in on a glue mixing and injecting device.

FIG. 2 shows a close up view of glue applicator station 40. Glue components A and B are contained in reservoirs 42*a* and 42*b*, respectively. Hoses 44*a* and 44*b* carry glue components A and B through pumps 70*a* and 70*b*, and temperature control devices 72*a* and 72*b* prior to mixing. For example, a two-part resorcinol adhesive system with relatively high solids and low water content is used. The product is obtained from Borden. Glue components A and B are then carried through temperature-controlled hoses 74*a* and 74*b*, respectively, into junction 76 where the glue components are combined and then mixed in static mix tubes 78. For example, temperature-controlled hoses 74*a* and 74*b* may be configured to maintain the temperature of the glue at around 150° F. The mixed glue then travels through tube 46 where it is dispensed through apertures, as previously described.

Figure 3:
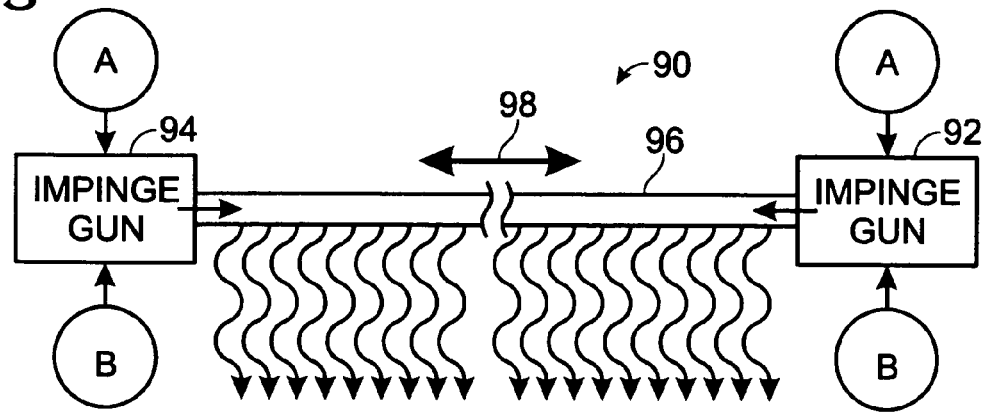
FIG. 3 is a schematic view illustrating the concept of dispensing glue in multiple zigzag patterns from an oscillating tube.

FIG. 3 shows a schematic illustration of glue applicator station 90. Separate impinge guns or glue injector devices 92 and 94 are positioned at opposite ends of tube 96. Additional glue sources may be positioned at intermediate locations along tube 96. Impinge guns 92 and 94 inject glue mixtures towards the center of tube 96. An oscillation device is used to move tube 96 back and forth in the direction of arrows 98.

Figure 4:
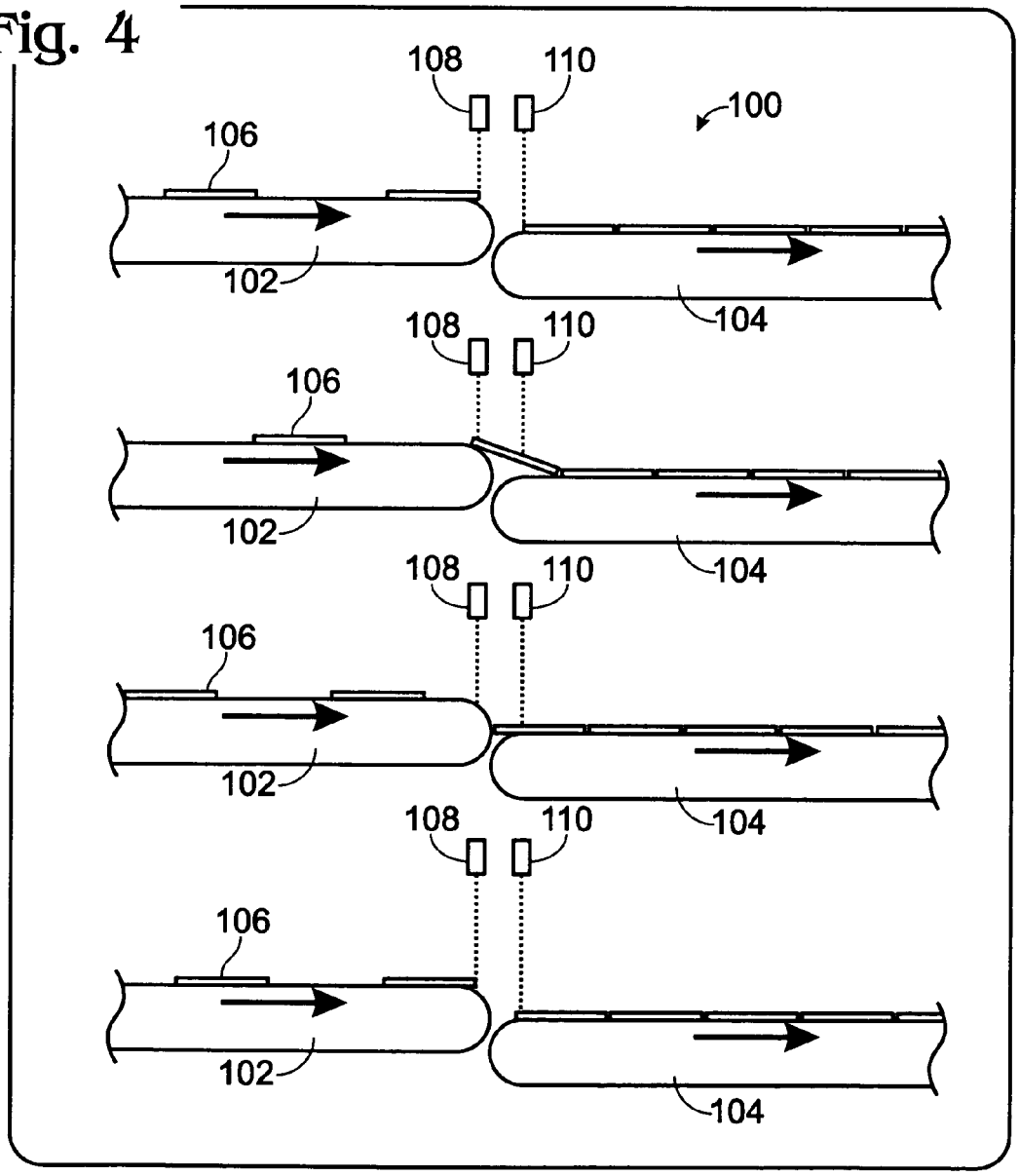
FIG. 4 is a series of schematic drawings illustrating a device for aligning and routing workpieces edge-to-edge prior to a glue dispensing station.

FIG. 4 is a series of schematic side views of a crowding conveyor device 100 for both deskewing or aligning workpieces, and arranging them edge-to-edge upstream from a glue applicator station, for example, as shown in FIG. 1. Infeed conveyor 102 is elevated relative to outfeed conveyor 104. Workpieces 106 on infeed conveyor 102 may be skewed and/or spaced apart. Haphazard workpiece spacing on a conveyor is not conducive to uniform and efficient glue application, particularly where it is desirable for the glue dispensing system to run continuously for long periods. Plural sensors 108 (only one shown) are arranged across the conveyor path near the end of infeed conveyor 102. Sensors 108 detect the edge of workpiece 106. If workpiece 106 is skewed, then the chain or track supporting the leading edge of workpiece 106 stops until the remaining edge catches up and is sensed by another sensor. Another sensor or set of sensors 110 is positioned near the upstream end of outfeed 104. When sensor 110 detects the trailing edge of workpiece 106, then a signal is sent to a controller which turns on infeed 102 to deliver another workpiece 106 to outfeed conveyor 104, as shown in the second view in FIG. 4.

Figure 5:
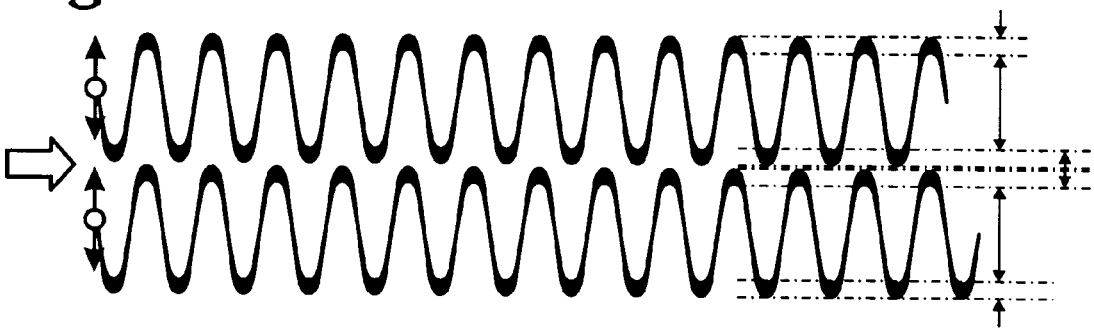
FIGS. 5-9 are schematic views of glue application patterns that may be achieved with different examples of the invention.
Figure 6:
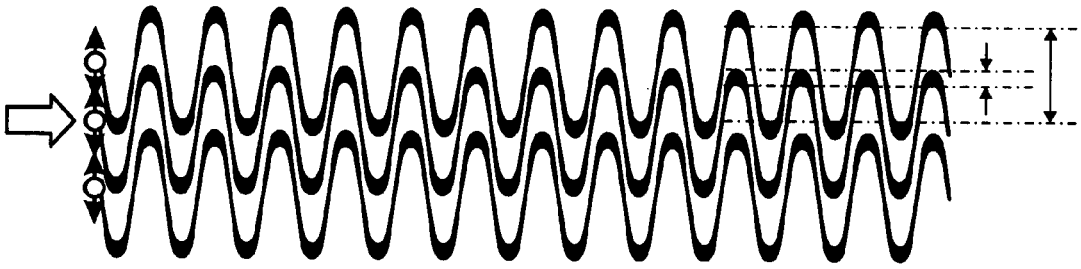
Figure 7:
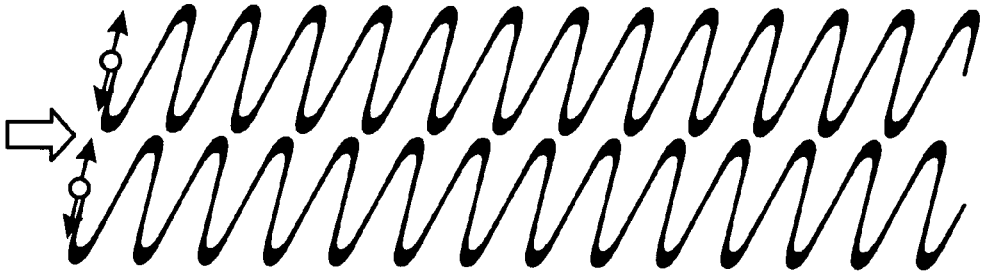

FIGS. 5-7 show different glue application patterns that may be achieved by varying the configuration of the glue applicator system, as previously described. FIG. 5 shows parallel zigzag patterns resulting from oscillation of an applicator tube with plural apertures, the tube being oriented substantially perpendicular to the conveyor path direction.

FIG. 6 shows a variation of the glue pattern of FIG. 5 in which the individual zigzag paths overlap to some extent. A pattern in FIG. 6 may be useful if there is a disparity between the amount deposited at the apex (direction reversal) versus the linear portions of each path. FIG. 7 shows the result of altering the line of deposition to be obliquely oriented relative to the conveyor path.

Figure 8:
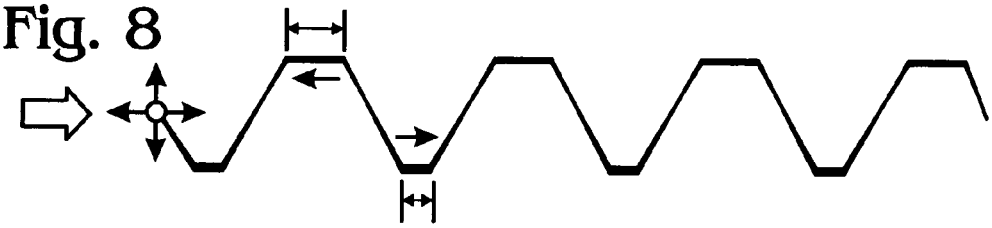
Figure 9:
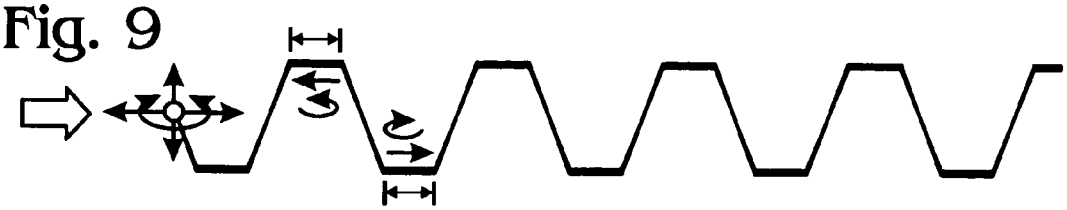

FIGS. 8 and 9 show further glue pattern variations that are achieved by adding one or more additional movements to a deposition tube or nozzle, in addition to side-to-side oscillating movement as previously described. In FIG. 8, the deposition node is oscillated in two directions that are perpendicular to each other. FIG. 9 shows a glue deposition design produced by moving a deposition aperture or node in the same direction shown in FIG. 8, and additionally rotating the deposition tube around its axis to some extent.

Numerous other deposition patterns may be achieved by, for example, using a tip device to alter the dispersion path of the glue. For example, a tip configuration may be used to generate a spray-like dispersion which may or may not be used in conjunction with an oscillating motion.

Figure 10:
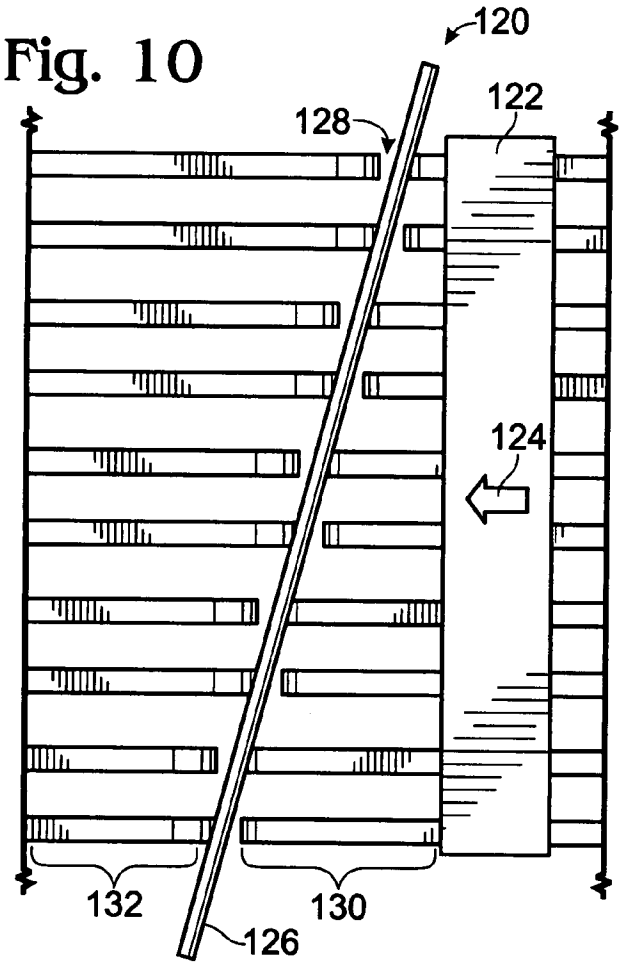
FIG. 10 is a schematic top view of a glue application device oriented obliquely relative to a material transport path.

FIG. 10 shows a glue deposition configuration that may be used to create a glue pattern such as the one shown in FIG. 7. Glue applicator station 120 is shown in FIG. 10. Workpiece 122 is conveyed along conveyor path 124. Glue deposition tube 126 is oriented obliquely relative to conveyor path 124. Gap 128 is defined between conveyor sets 130 and 132 to facilitate purging and servicing of applicator tube 126. Conveyor tracks in each set 130 and 132 are staggered so that gap 128 is aligned with tube 126. An advantage of this configuration is that workpiece 122 passes over gap 128 gradually, with continuous support from the conveyors, in contrast to a different configuration in which a conveyor gap is perpendicular to the conveyor path.

Figure 11:
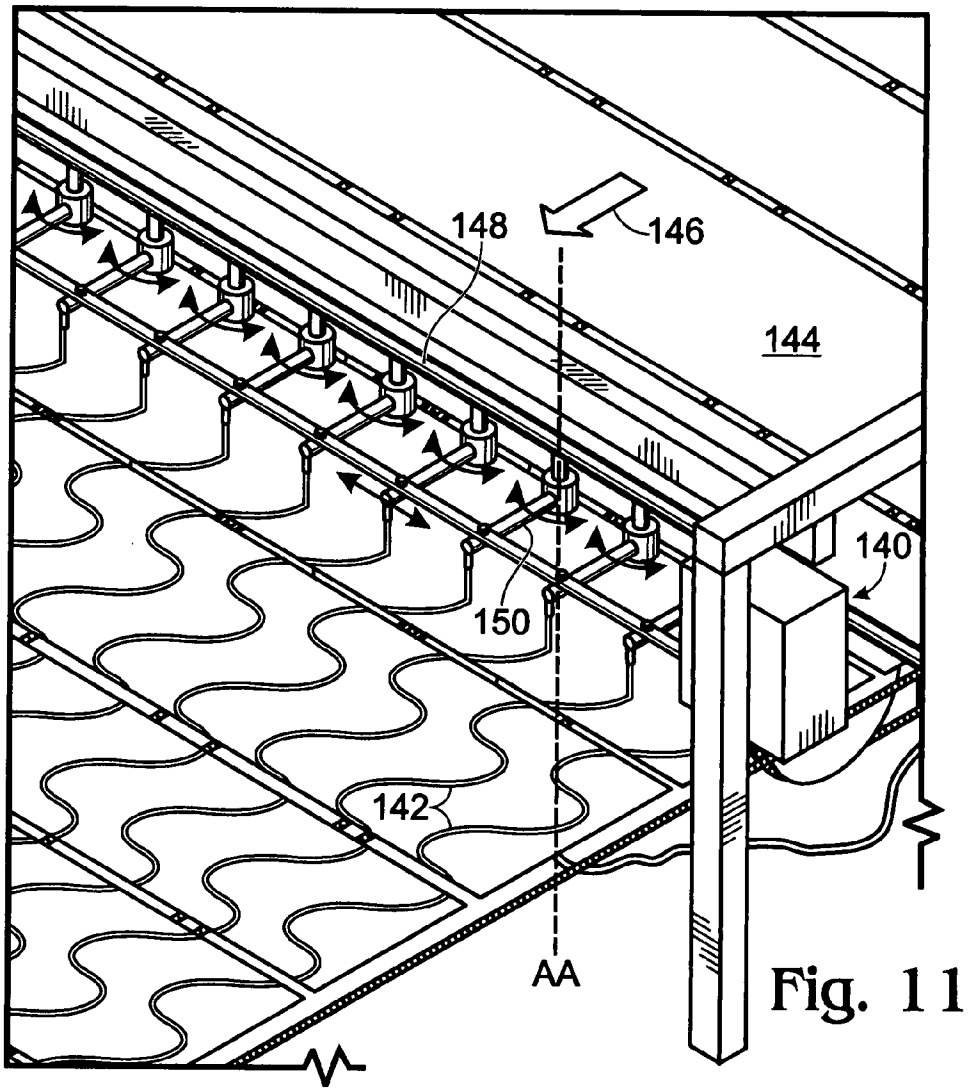
FIG. 11 is a partial perspective view of another example of the invention in which a plurality of applicators are individually oscillated.

FIG. 11 shows an alternative example of the invention. Glue application system 140 is used to deposit glue lines 142 on workpieces 144 along conveyor path 146. Tube 148 receives mixed adhesive from both ends, as previously described. A plurality of deposition devices 150 branch off of tube 148. Each deposition device 150 has a drive mechanism such as a motor for rotating the device back and forth to some extent around axis AA.

FIGS. 12-14 show another example of the invention. Similar to the examples shown in FIG. 11, a plurality of deposition devices are driven individually and independently to produce the desired deposition pattern. Additionally, in the example shown in FIGS. 12-14, each deposition device receives individual glue components, and mixes the glue system immediately before depositing the mixture on the workpiece. This configuration enables use of glue components that gel quite rapidly, for example, in less than 15, 10, or 5 minutes. As shown in FIG. 12, glue applicator station 160 has multiple glue applicating devices 162 arranged across conveyor path 164. Each glue application device 162 has two glue lines for carrying glue components A and B separately, and a purge line for carrying water or some other fluid to keep the deposition conduit clear when not being used.

FIG. 13 shows glue application device 162 partially exploded. Fittings 164 and 166 are provided for receiving glue components A and B. Fitting 168 is provided for receiving water to purge the line. Glue component lines join and merge into static mix tube 170. Static mix tube 170 feeds into housing block 172. Housing block 172 may be positioned, for example, approximately two feet above the conveyor. Rotating cylinder 174 is seated in housing block 172. Cylinder 174 has a funnel-shaped aperture 176 for receiving mixed glue. Nut portion 178 is received in female fitting 180 which is rotationally driven by drive mechanism 182. Air lines 184 and 186 are provided for pneumatic operation of drive mechanism 182.

FIG. 14 shows a cross-section through housing block 172 and rotating cylinder 174. Rotating cylinder 174 has a funnel-shaped portion 190 leading to a straight conduit portion 192.

Figure 15:
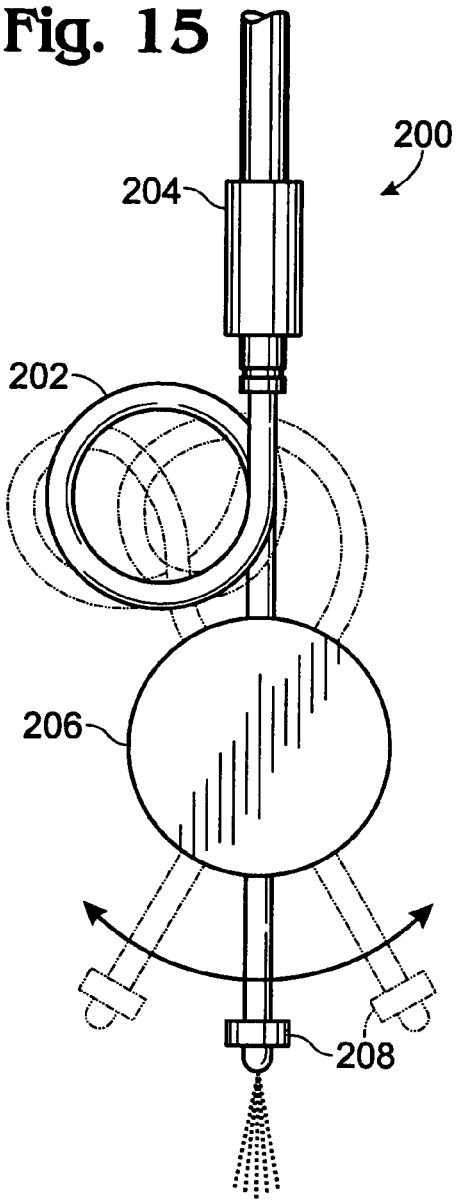
FIG. 15 is a partial side view of another glue dispensing mechanism.

FIG. 15 shows another glue dispensing mechanism 200 using a flexible tube 202 and a device for oscillating the tube back and forth to produce a glue pattern on a work piece in accordance with examples described above. Flexible tube 202 is fed an activated glue mixture from pumping and mixing apparatus as previously described. Tube 202 may, for example, be made of Teflon and have an outer diameter of ⅛-inch and an inner diameter of 1/16-inch. Tube 202 makes a 360-degree loop after exiting static mix tube 204. Tube 202 then passes through a graduated aperture in rotating cylinder 206. Tube 202 also may have tip 208 for creating a particular stream or spray distribution.

Figure 16:
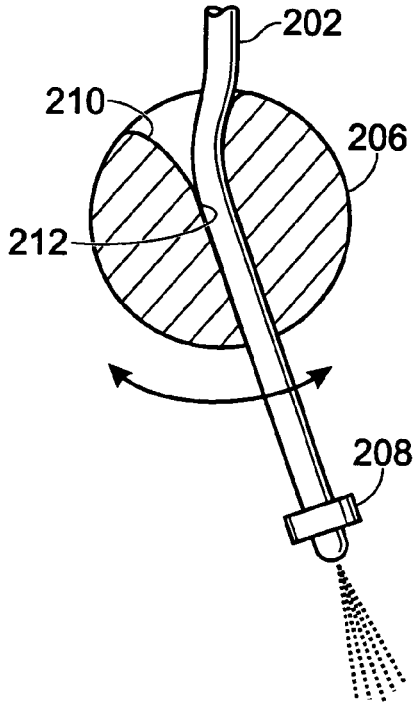
FIG. 16 is a partial cross sectional view of the glue dispensing mechanism of FIG. 15.

FIG. 16 shows a cross section through rotating cylinder 206. As shown, upper portion 210 of passage or aperture 212 is graduated. Rotating cylinder 206 may be positioned approximately 5- or 6-feet above the material being conveyed. The cylinder rotates rapidly, for example, approximately 700-oscillations-per-minute. A single dispenser has been used to deposit glue uniformly across an 8-foot material width.

Figure 17:
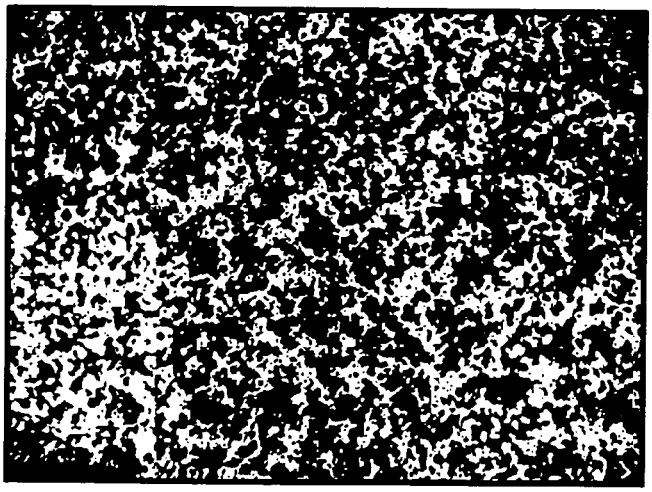
FIG. 17 shows an applied glue pattern achieved with the dispensing mechanism shown in FIGS. 15 and 16.

FIG. 17 shows a glue splatter pattern created by an application device such as the one shown in FIGS. 15 and 16.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower or equal in scope to the original claims, are also regarded as included within the subject matter of the inventions of the present disclosure.

I claim:

1. A method of dispensing adhesive comprising conveying a piece of material along a processing path under an adhesive dispenser system having a plurality of stations arranged across the processing path, each station including two glue supply lines for carrying glue components A and B separately, a mixing chamber connected downstream from the two glue supply lines for thoroughly mixing glue components A and B immediately before dispensing, and a deposition device connected downstream from the mixing chamber, each deposition device having a drive mechanism including a motor configured to oscillate the deposition device;

separately adding adhesive components A and B within the mixing chamber of each station, to form a rapid gelling adhesive;

independently oscillating the deposition device at each station; and dispensing the rapid gelling adhesive through the oscillating deposition device of each station producing a substantially uniform adhesive distribution across the processing path, wherein each deposition device includes a housing device having a bore, and a rotatable cylinder located in the bore of the housing device, the cylinder having an aperture directed toward the processing path, the method further comprising the step of channeling mixed adhesive from the mixing chamber to the aperture in the cylinder, and rotating the cylinder, thereby producing a selected adhesive deposition pattern on the material.

2. The method of claim 1, wherein the aperture in the cylinder has a funnel-shaped portion leading to a straight conduit portion.

3. A method of dispensing adhesive comprising conveying a piece of material along a processing path under an adhesive dispenser system having a plurality of stations arranged across the processing path, each station including two glue supply lines for carrying glue components A and B separately, a mixing chamber connected downstream from the two glue supply lines for thoroughly mixing glue components A and B immediately before dispensing, and a deposition device connected downstream from the mixing chamber, each deposition device having a drive mechanism including a motor configured to oscillate the deposition device;

separately adding adhesive components A and B within the mixing chamber of each station, to form a rapid gelling adhesive;

independently oscillating the deposition device at each station; and dispensing the rapid gelling adhesive through the oscillating deposition device of each station producing a substantially uniform adhesive distribution across the processing path, wherein each deposition device includes a rotating cylinder having an aperture directed toward the processing path, and a flexible tube running from the respective mixing chamber through the aperture in the cylinder, the method further comprising the step of rotating the cylinder, thereby producing a selected adhesive deposition pattern on the material.

4. The method of claim 3, wherein the aperture in the rotating cylinder has a graduated inner diameter.

5. The method of claim 3, wherein the flexible tube portion makes a 360 degree loop between the mixing chamber and the deposition device.

6. The method of claim 3, further comprising the step of rotating the cylinder approximately 700 oscillations-per-minute.

7. A method of dispensing adhesive comprising conveying a piece of material along a processing path under an adhesive dispenser system having a plurality of stations arranged across the processing path, each station including two glue supply lines for carrying glue components A and B separately, a mixing chamber connected downstream from the two glue supply lines for thoroughly mixing glue components A and B immediately before dispensing, and a deposition device connected downstream from the mixing chamber, each deposition device having a drive mechanism including a motor configured to oscillate the deposition device;

separately adding adhesive components A and B within the mixing chamber of each station, to form a rapid gelling adhesive;

independently oscillating the deposition device at each station; and dispensing the rapid gelling adhesive through the oscillating deposition device of each station producing a substantially uniform adhesive distribution across the processing path, wherein for at least one station, the deposition device includes an aperture in fluid communication with the mixing chamber, the aperture being adapted to receive and dispense the mixed rapid gelling adhesive, wherein the drive member for the at least one station is adapted to oscillate the aperture, and the dispensing step includes dispensing the rapid gelling adhesive through the oscillating aperture of the at least one station on to the material, and wherein for the at least one station, the deposition device includes a rotating member seated in a housing, the drive mechanism is adapted to rotate the rotating member within the housing, and the aperture passes through the rotating member, and further wherein the oscillating step includes rotating the rotating member of the at least one station within the housing.

8. The method of claim 7, wherein the drive mechanism of the at least one station is a pneumatic drive mechanism.

9. A method of dispensing adhesive comprising conveying a piece of material along a processing path under an adhesive dispenser system having a plurality of stations arranged across the processing path, each station including two glue supply lines for carrying glue components A and B separately, a mixing chamber connected downstream from the two glue supply lines for thoroughly mixing glue components A and B immediately before dispensing, and a deposition device connected downstream from the mixing chamber, each deposition device having a drive mechanism including a motor configured to oscillate the deposition device;

separately adding adhesive components A and B within the mixing chamber of each station, to form a rapid gelling adhesive;

independently oscillating the deposition device at each station; and dispensing the rapid gelling adhesive through the oscillating deposition device of each station producing a substantially uniform adhesive distribution across the processing path, wherein for at least one station, the deposition device includes a flexible tube in fluid communication with the mixing chamber, the flexible tube being adapted to receive the mixed rapid gelling adhesive, and to dispense the rapid gelling adhesive through a dispensing tip, wherein the drive member is adapted to oscillate the dispensing tip through the path, and further wherein the oscillating step includes oscillating the dispensing tip of the at least one station through the path with the drive mechanism, and the dispensing step includes dispensing the rapid gelling adhesive through the dispensing tip of the at least one station on to the material, and wherein for the at least one station, the deposition device includes a rotating member seated in a housing, the rotating member including an aperture therethrough, wherein the flexible tube passes through the aperture, and the drive mechanism is adapted to oscillate the rotating member within the housing, thereby causing the dispensing tip to oscillate, and further wherein the oscillating step includes oscillating the rotating member of the at least one station within the housing with the drive mechanism thereby causing the dispensing tip to oscillate, and the dispensing step includes dispensing the rapid gelling adhesive through the oscillating dispensing tip of the at least one station and on to the material.

10. The method of claim 9, wherein the oscillating step includes oscillating the rotating member at approximately 700-oscillations-per-minute.

* * * * *